US010027068B2

(12) United States Patent
Neumueller

(10) Patent No.: US 10,027,068 B2
(45) Date of Patent: Jul. 17, 2018

(54) PLUG SOCKET WITH CURRENT TRANSFORMER

(71) Applicant: SIEMENS AKTIENGESELLSCHAFT, Munich (DE)

(72) Inventor: Gernot Neumueller, Lichtenberg (AT)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/420,323

(22) Filed: Jan. 31, 2017

(65) Prior Publication Data

US 2018/0115121 A1 Apr. 26, 2018

(30) Foreign Application Priority Data

Oct. 24, 2016 (DE) ..... 10 2016 220 862

(51) Int. Cl.
*H01R 33/09* (2006.01)
*H01R 13/66* (2006.01)
*H01F 38/30* (2006.01)

(52) U.S. Cl.
CPC ..... *H01R 13/6683* (2013.01); *H01F 38/30* (2013.01)

(58) Field of Classification Search
CPC ..... H01R 13/6683; H01F 38/30
USPC ..... 439/620.21
See application file for complete search history.

(56) References Cited

U.S. PATENT DOCUMENTS 5,349,146 A * 9/1994 Radabaugh ..... A47L 5/38 15/314
2014/0273608 A1* 9/2014 Whetstone ..... H01R 13/6683 439/488

FOREIGN PATENT DOCUMENTS

DE 4435864 A1 * 4/1996 ..... G01R 15/142
EP 0424699 A2 5/1991

* cited by examiner

*Primary Examiner* — Abdullah Riyami
*Assistant Examiner* — Nader Alhawamdeh
(74) *Attorney, Agent, or Firm* — Laurence Greenberg; Werner Stemer; Ralph Locher

(57) ABSTRACT

An apparatus for connecting an electrical device to a high-voltage power grid with a leadthrough plug-in bushing which has a hollow receiving section which extends in a plug-in direction and is composed of an electrically non-conductive insulating material, wherein a metallic contact part is arranged on a closed end region of the receiving section, which metallic contact part extends through the insulating material of the receiving section or lengthens said receiving section in the direction of the closed end region. The apparatus can be assembled and serviced in a simple, quick and therefore cost-effective manner. The receiving section is equipped with a current sensor which is designed to detect an electric current flowing across the metallic contact part.

13 Claims, 1 Drawing Sheet

PLUG SOCKET WITH CURRENT TRANSFORMER

BACKGROUND OF THE INVENTION

Field of the Invention

The invention relates to an apparatus for connecting an electrical device to a high-voltage power grid with a leadthrough plug-in bushing which has a hollow receiving section which extends in a plug-in direction and is composed of an electrically nonconductive insulating material, wherein a metallic contact part is arranged on a closed end region of the receiving section, which metallic contact part extends through the insulating material of the receiving section or lengthens said receiving section in the direction of the closed end region.

The invention further relates to an electrical device for connection to a high-voltage power grid, comprising a magnetizable core, at least one winding which surrounds a section of the core, and a tank which is filled with an insulating fluid and in which the core and each winding are arranged.

An apparatus of this kind and an electrical device of this kind are known to a person skilled in the art from practice. By way of example, transformers have tanks which are filled with a mineral oil or natural ester and in which a magnetizable core and a winding are arranged, wherein the oil bath allows the necessary electrical insulation and the cooling of the winding. In order to seal off the tank interior, which is filled with the insulating fluid, from the external atmosphere, but at the same time to allow quick fitting of the transformer, so-called leadthrough plug-in bushings have been proposed. The leadthrough plug-in bushings extend into the tank interior by way of their receiving section which is manufactured from insulating material, wherein a plug-in end of a leadthrough is designed to complement the hollow receiving section in terms of shape. A metallic contact part of the leadthrough plug-in bushing is connected to a winding of the transformer by means of a connecting line which is likewise arranged in the tank. If a high-voltage leadthrough is now inserted into the receiving section, an outdoor connection of the high-voltage leadthrough is electrically connected to the winding of the transformer. In order to detect a current flowing between said outdoor connection and the winding, the connecting line, for example, is equipped with a current sensor.

The previously known apparatus has the disadvantage that the current sensor is arranged in the connection region between the leadthrough plug-in bushing and the winding, that is to say deep inside the tank interior, so that the assembly and configuration of the current sensor is complicated and, respectively, extensive.

BRIEF SUMMARY OF THE INVENTION

The object of the invention is therefore to provide an apparatus of the kind mentioned at the outset which can be assembled and serviced in a simple, quick and therefore cost-effective manner and at the same time is compact, in order to be able to arrange said apparatus both in a transformer dome and also beneath a transformer cover.

The invention achieves this object in that the receiving section is equipped with a current sensor which is designed to detect an electric current flowing across the metallic contact part.

A leadthrough plug-in bushing which is equipped with a current sensor is provided within the scope of the invention. The leadthrough plug-in bushing is fitted on an electrical device, for example a transformer or a choke, by means of its fastening section, wherein the receiving section extends into an oil space in said electrical device. Arranging a current sensor in a tank interior which is far away from the cover and therefore difficult to access is dispensed with in the scope of the invention. According to the invention, the current sensor is arranged in the immediate vicinity of the receiving section of the leadthrough plug-in bushing at a minimum distance from said leadthrough plug-in bushing. Therefore, the current sensor is easily accessible from the outside in the event of a fault. Therefore, the insulating fluid has to be drained off only as far as the receiving section, in order to obtain access to the apparatus according to the invention. Within the scope of the invention, the leadthrough plug-in bushing which is detachably connected to the tank can be quickly detached from the electrical device, so that it is possible to access the current sensor. Therefore, the current sensor can be easily replaced, fitted or repaired within the scope of the invention.

Any desired current sensors which are commercially available, such as current transformers for example, can be used as current sensors within the scope of the invention in principle.

According to the invention, the above-described apparatus is electrically connected, by way of its contact part, to a winding of the electrical device. Therefore, an electrical device, for example a transformer or else a choke, is provided within the scope of the invention, it being possible for the current sensor of said electrical device to be serviced in a quick and in a simple manner. Expenditure on assembly and costs of the electrical device are reduced owing to the compact design of the current transformer and of the receiving section.

The current sensor is expediently arranged directly around the receiving section and maintains a specific minimum distance from said receiving section with respect to the necessary dielectric strength. In addition to this insulating separation, these two components are arranged in relation to one another such that high electrical field strengths are avoided.

The current sensor can be configured as desired within the scope of the invention.

However, the current sensor advantageously has a circumferentially closed annular section into which the receiving section extends. The closed annular section is designed, for example, as a winding which provides an output signal which is dependent on the current flowing to the contact part.

According to a preferred configuration, the receiving section is designed to be rotationally symmetrical in relation to an axis which extends in the plug-in direction, wherein the annular section delimits a circular cylinder and is arranged concentrically in relation to the receiving section. In other words, the rotationally symmetrical, for example conical, hollow receiving section extends centrally through the ring-like annular section.

According to a preferred configuration of the apparatus according to the invention, an insulation barrier which is composed of an electrically nonconductive insulating material is arranged between the receiving section and the current sensor. The insulation barrier ensures expedient limiting of the electrical and/or magnetic field strengths, so that the current sensor is not damaged. The insulation barrier consists of particleboard for example. In this case, the particleboard can form a single ring-like wall or delimit ring-like channels which run parallel to one another, wherein the hollow cylinder which is delimited by the ring-like wall or said channels are filled with insulating fluid during operation of the electrical device. In addition to particleboard, nonconductive plastics, such as resins or the like for example, can be used as insulating material within the scope of the invention.

A fastening unit is expediently provided for fastening the apparatus to a tank of the electrical device. The fastening unit comprises, for example, a flange section which can be fastened to a flange which is formed on the tank. Sealing rings are expediently provided in this case, so that a fluid-tight connection is provided.

The fastening unit is expediently mechanically connected both to the plug-in bushing and also to the current transformer. According to this advantageous further development, the leadthrough plug-in bushing and the current transformer are designed as a mechanical unit. According to this further development, the assembly time is yet further reduced.

The tank of the electrical device according to the invention expediently has a cover, wherein the apparatus is fastened to the cover. The apparatus is fastened to the cover from the inside for example.

Furthermore, it is possible for the tank to form a receiving dome which protrudes from a wall of the tank, wherein the apparatus is arranged in the receiving dome. According to this further development, the assembly time is yet further reduced.

Further expedient configurations and advantages of the invention are the subject matter of the following description of exemplary embodiments of the invention with reference to the figures in the drawing, wherein identical reference signs refer to identically acting components, and wherein

DESCRIPTION OF THE INVENTION

Figure 1:
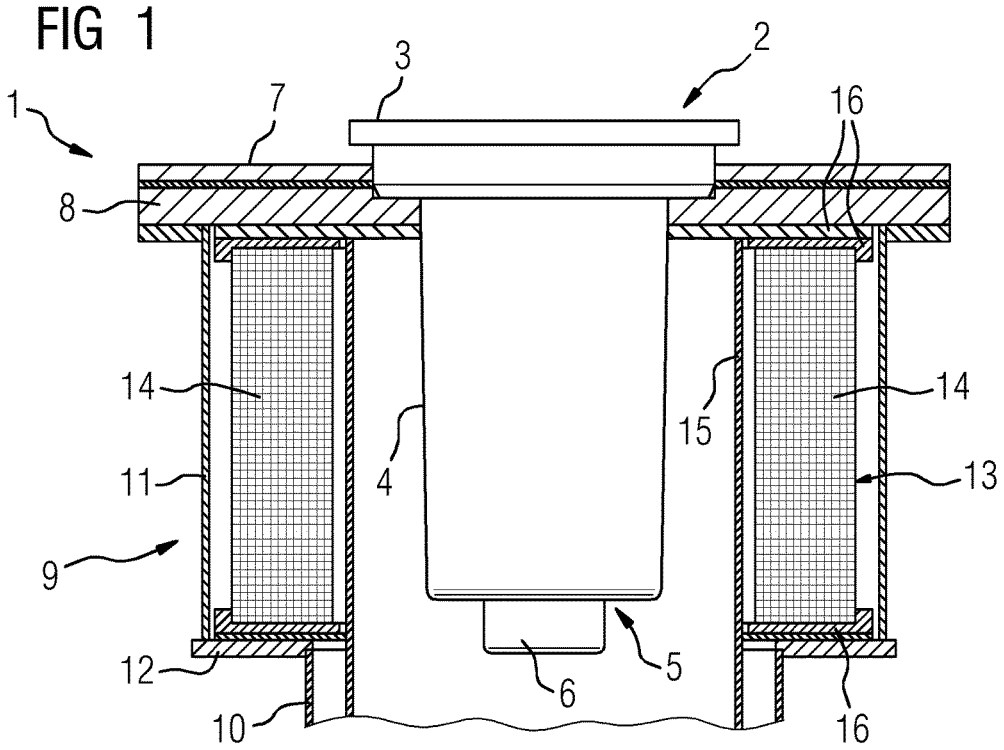
FIGS. 1 and 2 each show a schematic side view of an exemplary embodiment of the electrical apparatus according to the invention.

FIG. 1 shows a schematic side view of an exemplary embodiment of the apparatus 1 according to the invention. The apparatus 1 has a leadthrough plug-in bushing 2 which has a bushing flange section 3 and a receiving section 4. The receiving section 4 is conical and hollow on the inside, wherein it is open only on one side and has a closed end region 5. A contact part 6, which is connected to a winding of a transformer by means of a connecting line, not illustrated in the figures, extends through the closed end region 5. The receiving section 4 consists of an electrically nonconductive solid insulating material, for example a plastic. The hollow interior of the receiving section 4 is designed to complement the plug-in end of a high-voltage leadthrough in terms of shape, said high-voltage leadthrough, by way of its high-voltage conductor, making contact with the contact part 6 in the plugged-in state, so that an outdoor connection of the high-voltage leadthrough is electrically connected to said winding.

The bushing flange section 3 of the leadthrough plug-in bushing 2 is fixedly connected to an apparatus flange 7 which is fitted to a closure part 8 of a receiving dome 9. The receiving dome 9 has a lower section 10 of circular-cylindrical design and also an upper section 11, wherein the diameter of the upper section 11, which is likewise of circular-cylindrical design, is larger than the diameter of the lower section 10, so that a shoulder 12 is formed. The shoulder 12 serves to support a current sensor 13 which is schematically indicated by way of its annular section 14 here. The annular section 14 is of ring-like design and surrounds the receiving section 4, which extends concentrically into said annular section, over the full circumference. Therefore, when the high-voltage leadthrough is plugged in, the annular section is arranged concentrically in relation to the current flowing across the leadthrough and the contact part 6.

In the example shown, the annular section 14 is a winding which provides an output signal depending on a current flowing through the magnetic field of said winding. Therefore, a current flowing between the winding and the high-voltage leadthrough can be detected by the current sensor 13.

An insulation barrier 15 is shown between the annular section 14 and the current sensor 13. The insulation barrier 15 is in the form of a circular-cylindrical wall and therefore delimits a hollow-cylindrical interior into which the receiving section 4 extends in a concentric manner. The insulation barrier 15 is mechanically connected to holding elements 16, wherein an upper holding element 16 bears against the closure part 8 of the apparatus 1 and can be connected to said closure part if desired. In the exemplary embodiment shown, a mechanically cohesive composite comprising current sensor 13, insulation barrier 15 and holding elements 16 is shown, said composite being supported on the shoulder 12 of the receiving dome 9. The leadthrough plug-in bushing 2 is not mechanically connected to the current sensor before final assembly of the apparatus 1. Instead, the insertion section 4 is passed through an opening in the cover part 8 and then fastened to said cover part by means of flange 7 after the current sensor 13 is fitted.

Figure 2:
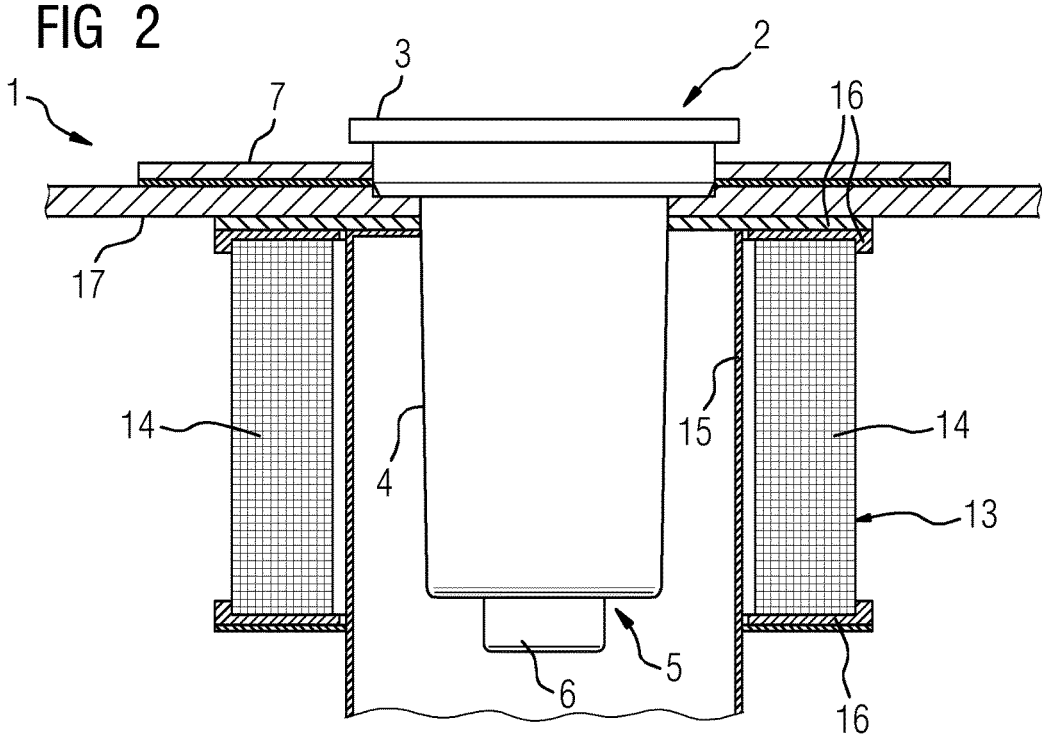

The exemplary embodiment illustrated in FIG. 2 corresponds to the greatest possible extent to the exemplary embodiment illustrated in FIG. 1, but with the apparatus 1 not being fitted in a receiving dome of a transformer but rather to a cover 17 of the tank of said transformer. Otherwise, the statements made in respect of FIG. 1 correspondingly apply wherein the cover 17 takes the place of the closure part 8. Furthermore, the upper holding elements are connected to the inner face of the cover 17.

The invention claimed is:

1. An electrical device for connection to a high-voltage power grid, the electrical device comprising:

a magnetizable core;

at least one winding surrounding a section of said core;

a tank filled with an insulating fluid and housing said core and said at least one winding; and an apparatus for connecting the electrical device to the high-voltage power grid, the apparatus including:

a leadthrough plug-in bushing with a hollow receiving section that extends in a plug-in direction and is composed of an electrically nonconductive insulating material, said receiving section having a closed end region;

a metallic contact part disposed on said closed end region of said receiving section, said metallic contact part extending through said insulating material of said receiving section or lengthening said receiving section in a direction of said closed end region, and said metallic contact part being electrically connected to said at least one winding; and a current sensor disposed at said receiving section for detecting an electric current flowing across said metallic contact part.

2. The electrical device according to claim 1, wherein said current sensor has a circumferentially closed annular section into which said receiving section extends.

3. The electrical device according to claim 2, wherein said receiving section rotationally symmetrical in relation to an axis that extends in the plug-in direction, and wherein said annular section delimits a circular cylinder and is arranged concentrically in relation to said receiving section.

4. The electrical device according to claim 1, which comprises an insulation barrier composed of an electrically nonconductive insulating material arranged between said receiving section and said current sensor.

5. The electrical device according to claim 4, wherein said insulating material of said insulation barrier comprises particleboard and/or plastic.

6. The electrical device according to claim 4, wherein said insulating material of said insulation barrier consists of particleboard and/or plastic.

7. The electrical device according to claim 1, wherein said insulating material comprises particleboard and/or plastic.

8. The electrical device according to claim 1, wherein said insulating material consists of particleboard and/or plastic.

9. The electrical device according to claim 1, which comprises a fastening unit for fastening the apparatus to a tank of the electrical device.

10. The electrical device according to claim 9, wherein said fastening unit is mechanically connected both to said leadthrough plug-in bushing and also to said current transformer.

11. The electrical device according to claim 1, wherein said at least one winding is one of a plurality of windings and each winding is connected to said metallic contact part.

12. The electrical device according to claim 1, wherein said tank comprises a cover and said apparatus is fastened to said cover.

13. The electrical device according to claim 1, wherein said tank forms a receiving dome which protrudes from a wall of said tank, and said apparatus is disposed in said receiving dome.

* * * * *